United States Patent [19]

O'Neill

[11] 4,015,294

[45] Apr. 5, 1977

[54] DIVING HELMET ASSEMBLY

[75] Inventor: Wilbur J. O'Neill, Severna Park, Md.

[73] Assignee: Westinghouse Electric Corporation, Pittsburgh, Pa.

[22] Filed: Nov. 15, 1972

[21] Appl. No.: 306,945

[52] U.S. Cl. ..... 2/2.1 R

[51] Int. Cl.[2] ..... B63C 11/12

[58] Field of Search ..... 2/2.1 R, 3 R, 6, 2.1 A

[56] References Cited

UNITED STATES PATENTS

| | | | |
|---|---|---|---|
| 3,223,086 | 12/1965 | Denton | 2/6 X |
| 3,242,500 | 3/1966 | Derr | 2/3 R |
| 3,293,659 | 12/1966 | Shepard | 2/6 |
| 3,344,433 | 10/1967 | Stapenhill | 2/3 R |
| 3,501,772 | 3/1970 | Wyckoff | 2/3 R |
| 3,534,408 | 10/1970 | Fifield | 2/2.1 R |
| 3,568,210 | 3/1971 | Marietta | 2/3 R |
| 3,616,463 | 11/1971 | Theodore et al. | 2/3 R |
| 3,726,620 | 4/1973 | Morton | 2/3 R |

*Primary Examiner*—Alfred R. Guest
*Attorney, Agent, or Firm*—D. Schron

[57] ABSTRACT

Described is a diving helmet which includes a relatively inexpensive adapter unit custom fitted to an individual diver. The assembly includes a standardized helmet body having an inner surface generally conforming to the surface of the adapter unit so as to be capable of being worn by any diver. A sealing arrangement is provided around the base portion of the helmet body and lift off forces are directly communicated to the diver's head.

14 Claims, 13 Drawing Figures

DIVING HELMET ASSEMBLY

CROSS-REFERENCE TO RELATED APPLICATIONS

The present case is related in subject matter to copending application Ser. No. 306,944 filed Nov. 15, 1972 and assigned to the same assignee as the present invention.

BACKGROUND OF THE INVENTION

1. Field of the Invention

The invention in general relates to helmets, and more particularly, to swimmable diving helmets.

2. Description of the Prior Art

Swimmable diving helmets are generally tailored and built for an individual diver to insure the maximum comfort when the diver is working under water. The customizing may be accomplished in a variety of ways — one of which is to fit pads onto the inner surface of a helmet. This approach adapts each helmet to an individual; however, each helmet built may be used only by the individual to whom it is fitted, and if a next diver wants to use the same helmet, it must be refitted or else the diver would suffer a poor fit which could cause painful pressure points and which could also allow his head to move within the helmet.

Diving helmets are fabricated with a sealing mechanism to maintain water-tight integrity. One type of sealing arrangement utilizes a neck-seal, and in use with a breathable gas being supplied to that helmet, there is a tendency, in various situations, for the helmet to lift off the diver's head due to a piston effect. In many prior art arrangements, this effect has been neutralized by arrangements resulting in discomfort to the diver.

When utilized in the swimming position, various helmets, particularly those in which the head is free to move, result in objectionable neck straining movements by the diver in order to counteract rotating couples due to buoyancy considerations.

SUMMARY OF THE INVENTION

The present invention obviates the problems encountered with prior art helmets by providing a relatively inexpensive adapter unit which is worn by the diver, and which has a standardized outer surface. The adapter unit is preferably custom fitted to the diver, and a helmet body is placed over the adapter unit. The helmet body has a standardized inner surface which generally conforms to the outer surface of the adapter unit.

The entire assembly fits very close to the diver's head which rests its weight directly on the adapter unit, which in turn rests directly on the helmet body, for various diver orientations. A sealing means is provided at the base of the helmet assembly, and a force transmittal means directly connects the sealing unit with the adapter unit. The adapter unit preferably transmits the piston forces to three different areas on the diver's head in a manner to distribute the lift-off force. The helmet assembly includes a breathing gas supply conduit thermally insulated so as to prevent condensation therein when operating in cold waters.

The design of the diving helmet assembly is such as to be approximately neutrally buoyant when supporting the diver's head so as not to produce rotating couples in the swimming position.

BRIEF DESCRIPTION OF THE DRAWINGS

Like parts have been given like reference numerals throughout.

DESCRIPTION OF THE PREFERRED EMBODIMENT

Figure 1:
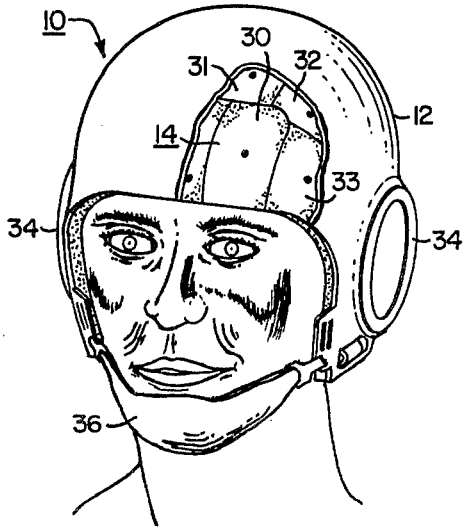
FIG. 1 is a view, with a portion broken away, of a diver worn adapter unit.

Referring now to FIG. 1, there is illustrated an adapter unit 10 to be worn by the diver and including an inner liner shell 12 and, as illustrated through the broken-away portion, padding means 14. The inner liner 12 has an outer surface which is made standardized to receive the helmet body 16 illustrated in FIG. 2. The helmet body 16 is constructed and arranged such that its inner surface is also of the standardized shape so as to generally conform with the shape of the inner liner 12 with the complementary surfaces being in intimate contact.

Figure 3:
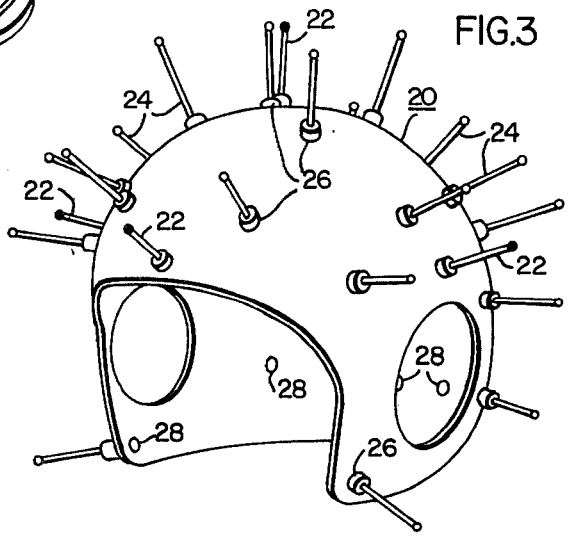
FIG. 3 illustrates a device for measuring head contours.
Figure 4:
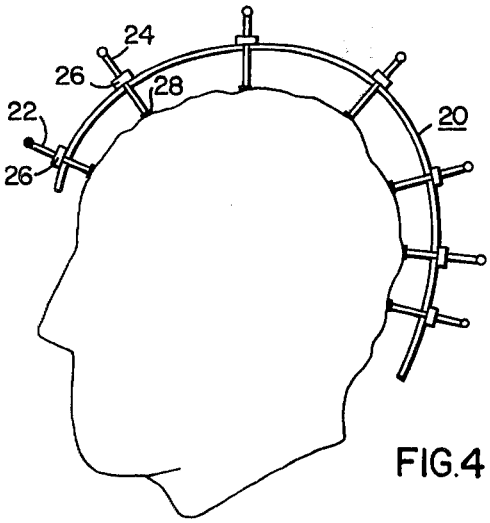
FIG. 4 illustrates a cross-sectional view through the device of FIG. 3 and placed on a head to be measured.

For some applications, the padding means 14 could be of uniform thickness; however, it is preferable that the adapter unit 10 be custom fitted to an individual diver. With additional reference to FIGS. 3 and 4, this customized fitting may be accomplished with the use of a head contour measuring device 20 having a surface, for example the inner surface, which conforms to the aforementioned standardized shape. The measuring device is perforated at a number of points to receive a plurality of rod-like probes. A plurality of these probes, 22, with the darkened beads at the ends thereof may be utilized as stand-offs for initially positioning the measuring device on the diver's head. The remainder of the probes 24, with the unshaded beaded ends are utilized as depth measuring probes. The probes may be threadedly engaged with respective base members 26 so as to be movable along a line perpendicular to the surface of the measuring device. Flat buttons 28 attached to the end of each probe contact the diver's head as in FIG. 4, and when contact is made, the probes, which are suitably calibrated such as in millimeters, will provide an indication of the head contour. The surface is divided into a plurality of areas, with each probe 24 being at the center of a respective area. Accordingly, for each probe measurement, a segment of padding may be cut to cover that same area on the inside of the inner liner 12 of FIG. 1. Accordingly, FIG. 1 shows a plurality of adjacent padding segments 30 to 33 in the cutaway portion.

The segments of padding means 14 are preferably an open-cell foam material which may be cemented into the proper respective locations inside the inner liner 12 which may be of a fiberglass construction to thereby effectively mold, or fit, the inner liner 12 to the diver's head. The open-cell foam padding not only provides a comfortable fit for the diver, but also aids in head impact protection, is a sound and temperature insulation, and allows gas passage so as not to be crushed at high ambient pressures, as would closed-cell foam materials.

The shell 12 has protruding portion 34 around the ears of the diver for placement of listening devices or weights for ballasting, as will be subsequently discussed and the unit is held in place by means of chin strap 36.

Each diver would then have his own individualized and custom fitted adapter unit for mating with the helmet body 16 which could be a mass-production item, since all helmet bodies could be of the same design and dimensions.

Figure 2:
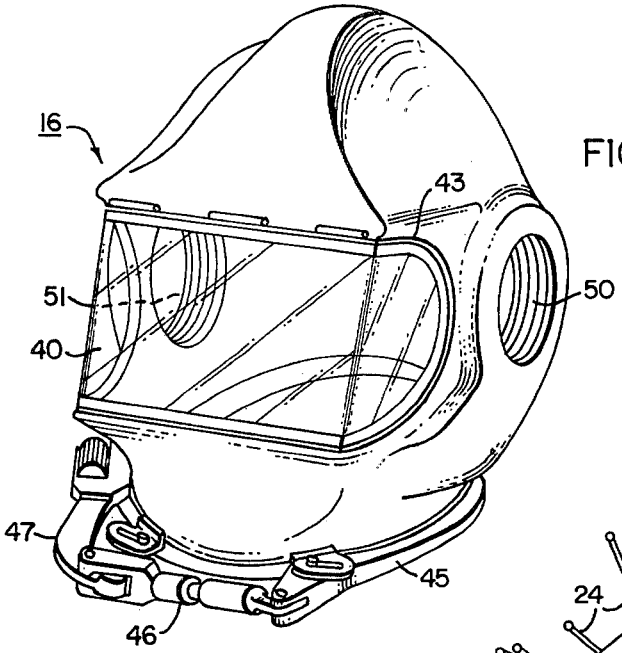
FIG. 2 is a view of a helmet body.

As seen in FIG. 2, the helmet body 16 includes a window 40 with an appropriate window seal 43.

Located at the base of the helmet body 16 is a clamping means 45 operable by means of a locking mechanism 46 including an actuating arm 47. Such arrangements are well known to those skilled in the art.

The helmet body 16 includes receptacle means 50 and 51 on opposite sides of the helmet body at an area adjacent to where the diver's ears would normally be located. These receptacle means are adapted to receive particular valve structures, or the like, as described and claimed in the aforementioned patent application.

Figure 5:
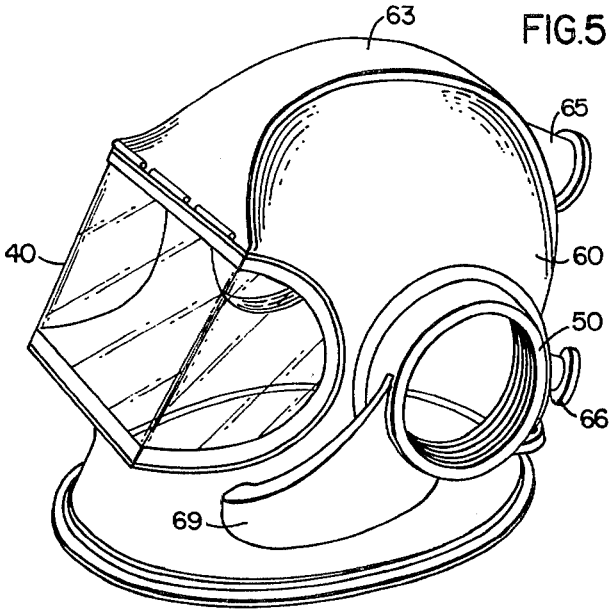
FIGS. 5, 6 and 7 are three different views of sub-surface portions of the helmet body of FIG. 1.
Figure 6:
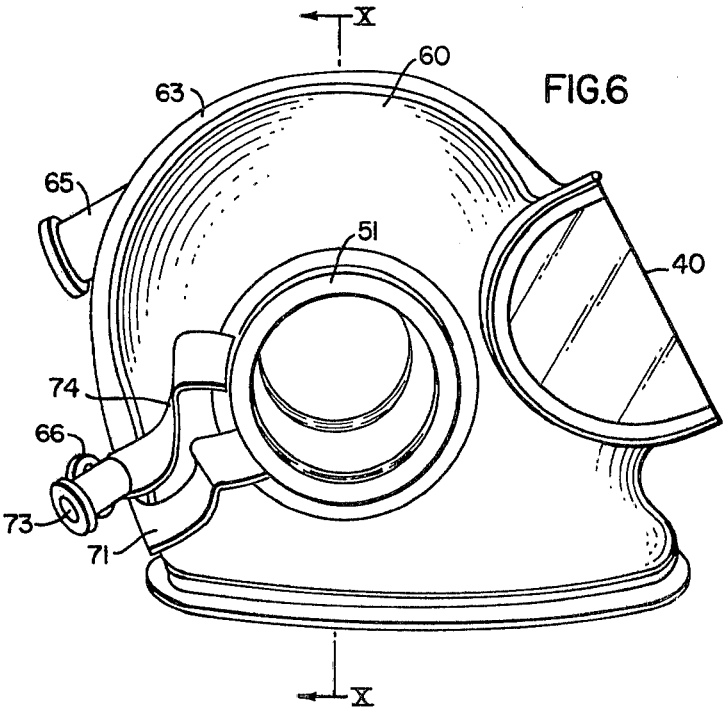
Figure 7:
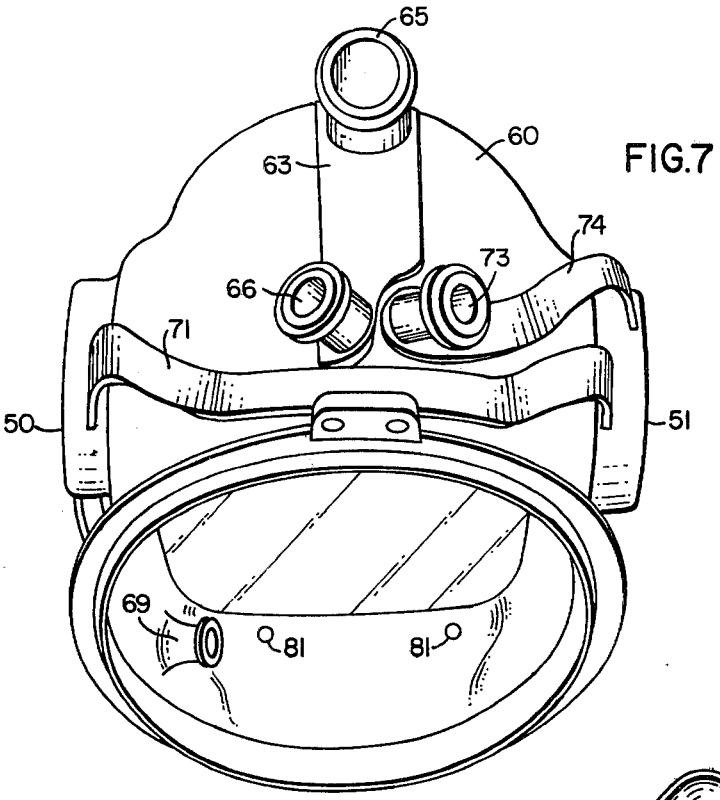

The helmet body construction is started with a helmet shell 60 (e.g.fiberglass), three views of which are illustrated in FIGS. 5, 6 and 7. FIG. 5 is a view looking down at the left side and showing a portion of the front; FIG. 6 is a view of the right side; and FIG. 7 is a view of the rear portion looking up into the shell.

A breathable gas supply passageway or duct 63 passing over the top of the shell 60 is operable to receive breathing gas at either input 65 or 66 and deliver it to the inside of the assembly at a position just above the window 40 so as to be breathed by the diver. Diver exhaled gas is conducted by means of an exhaust duct 69 to the receptacle means 50. A portion of the exhaust duct 69 is outside the shell 60 as seen in FIG. 5, and a portion is inside the shell as seen in FIG. 7. The receptacle means 50 is operable to receive a particular valve structure for directing gas flow and includes a plurality of chambers which are interconnectable by means of the inserted valve, and the two receptacle means are interconnected by means of duct 71 as illustrated in FIG. 7. One of the chambers of the receptacle means 51 is communicative with a fitting 73 on the back of the helmet by means of duct 74.

Figure 8:
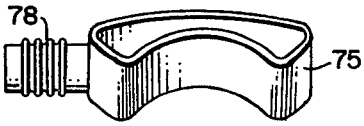
FIGS. 8 and 9 are respective views of a gas exhalation collector and oral-nasal mask which can be utilized with the helmet assembly.
Figure 9:
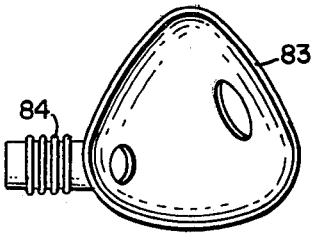

As is described in the copending application, the receptacle means and various ducts are brought into particular use depending upon the gas supply system utilized. In one mode of operation, the diver's exhaled breath may be directed to an exhalation collector 75, illustrated in FIG. 8, which fits against the diver's chin underneath his mouth and is connectable with the exhaust duct 69 inside the shell by means of tube 78 which fits over the beaded end of duct 69. Snaps on the front of collector 75 are engageable with snap receptacles 81 just below the window, in FIG. 7. In another mode of operation, the oral-nasal mask 83 illustrated in FIG. 9 is connected by means of tube 84 to the exhaust duct 69.

Figure 10:
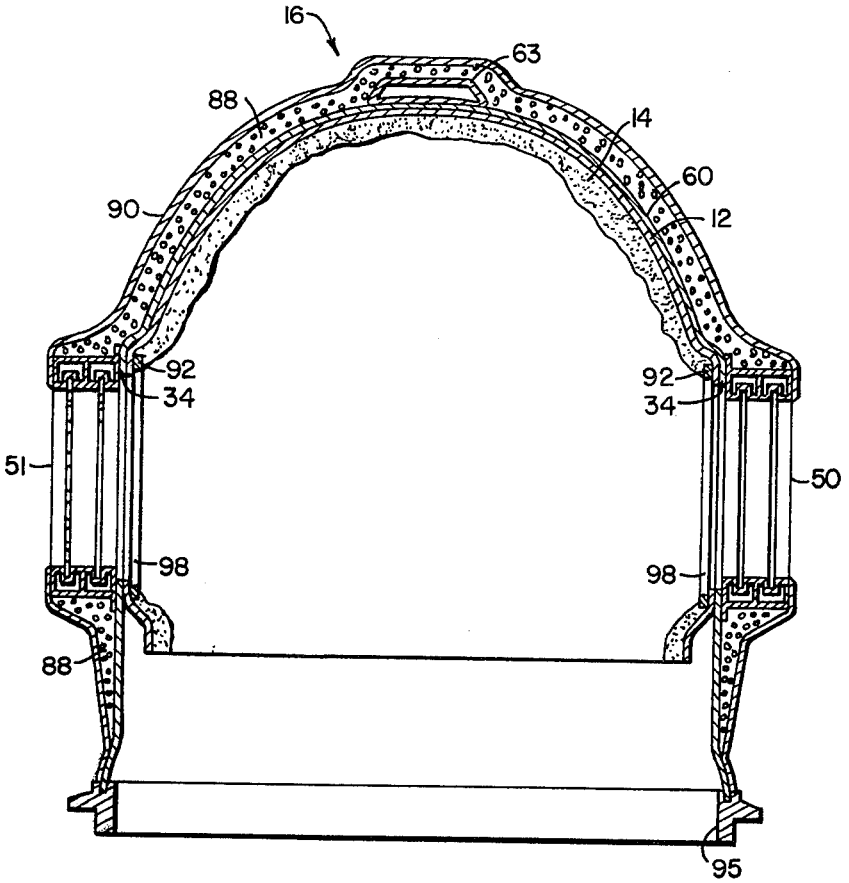
FIG. 10 is a head-on cross-sectional view along the lines X—X of FIG. 6.

Since gas may be flowing in the ducts, and particularly the supply duct 63, there is a possibility that objectionable condensation would form in the interiors thereof when the diver is working in cold waters. In order to minimize or eliminate condensation forming, the next step in the construction of the helmet body includes the application of a thermal barrier means in the form of an insulation. FIG. 10 is a cross-sectional view along the lines X—X of FIG. 6 and includes further construction material. Accordingly, in FIG. 10, disposed around the shell 60 and the duct 63 is the thermal insulating material 88 which may be fabricated of a hardened resin binder with hollow microspheres, which microspheres not only increase the insulation properties of the resin, but additionally decrease the weight thereof. Such material is sometimes referred to as syntatic foam and in the helmet application this insulation would still retain its insulating property regardless of diver depth, since the material is relatively incompressible. Even with a different gas supply arrangement, that is, in the absence of ducts, the insulation 88 would afford thermal protection for the diver's head, an important consideration since the human body gives up heat very rapidly through the head.

In order to protect the insulation from chipping, or other damage, a protective outer skin 90 is formed over the insulation 88 to form the outside surface of the helmet, as illustrated in FIG. 2. The outer skin 90 is preferably fabricated of a hard substance to afford protection, one example of which is fiberglass.

The intimate contact between the inner liner shell 12 and the helmet body shell 60 can be seen in FIG. 10 and this contact is maintained over the major portion of the inner liner shell surface. In the area designated by reference numeral 92, it is seen that the shell 60 even conforms to the shape of protrusion portion 34 and, past the lower part of protrusion portion 34, drops straight down and thereafter makes contact and is connected with a base ring 95.

For swimmable diving apparatus, helmets with enough internal volume to allow head movement inside are undesirable. The helmet must be neutrally buoyant for swimmability; otherwise, energy-wasting couples exist trying to tip the diver out of the normally horizontal swimming position. The more water a helmet displaces, the more weight is required to neutralize its buoyancy. The present diving helmet assembly, with its closely fitting constructional layers, results in a minimal displacement unit, thus reducing its dry weight and water displacement. The helmet is of a volume and weight design so as to be neutrally buoyant in the water when supporting the weight of the head. To achieve this design goal of neutral buoyancy it has been determined through human engineering studies that 95% of the population will have a head weight of approximately 15.2 lbs. or less. Depending upon the diver's size and weight, therefore, ballast may be added to the adapter unit to effectively achieve a 15.2 lb. head within the diving helmet assembly. The ballast weights are preferably located diametrically opposed on an axis passing through the center of gravity of the diver's head; and one such ballast arrangement is illustrated in FIG. 10 as including weights 98, each being in the form of an annular ring positioned within the protrusion portion 34 of the inner liner shell 12.

Thus, in the swimming position, or with the diver on his side or back, the adapter unit 10 constitutes forehead, side and back padding that allow the weight of the diver's head to be directly supported by the designed-in buoyancy of the helmet assembly.

Figure 11:
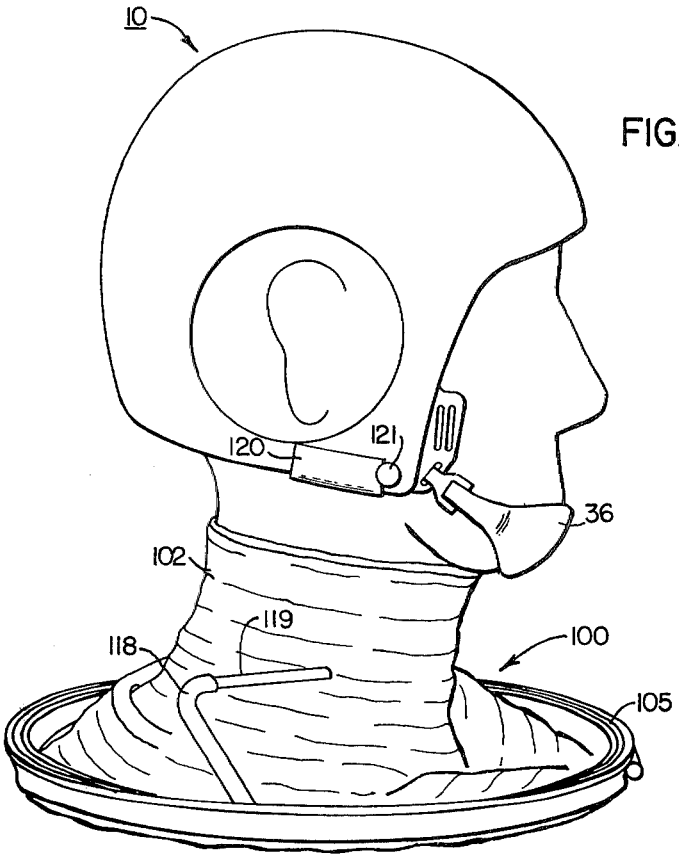
FIG. 11 is a view of one type of neck seal arrangement.

A suitable sealing arrangement is provided such as to a diver's suit, vest, and/or neck in order to maintain gas integrity. In the preferred embodiment, a neck-seal unit 100, illustrated in FIG. 11, is utilized. The neck-seal unit 100 includes a flexible neck-engaging membrane 102 which, like the adapter unit 10, is individually fitted to the diver by means of a central aperture cut to the size and shape of the diver's neck. The neck-engaging membrane 102 is secured to a neck ring 105, which is preferably oblong in shape, as is the human head, to avoid any increase in weight and displacement as would be inherent were a round neck ring utilized.

Figure 12:
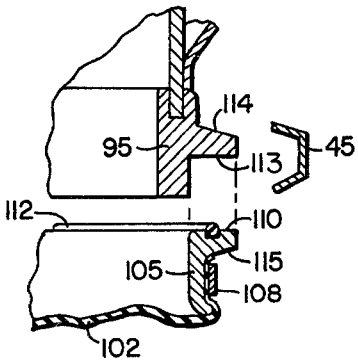
FIG. 12 illustrates an exploded cross-sectional view of the sealing surfaces.

The neck ring 105 mates with the base ring 95 of the helmet body, as illustrated in FIG. 12 which shows a cross-section through both rings. The flexible neck engaging membrane 102 is secured to the neck ring 105 by means of a band clamp 108. The neck ring 105 includes a grooved top surface 110 for receiving an O-ring 113, and this grooved surface mates with the bottom surface 112 of base ring 95. When the two surfaces are thus contacting, a clamp member 45 which engages a top surface portion 114 of base ring 95 and bottom surface portion 115 of neck 105 is brought into locking engagement by means of the locking mechanism 46 (FIG. 2).

Referring once again to FIG. 11, the neck ring 105 includes force transmittal members in the form of rigid links, of which one, 118, can be seen. The other link would be at a similar position on the left side. When donning the apparatus, the end 119 of the link 118 is inserted into a receiver 120 affixed to the adapter unit 10, and is held in place by means of setscrew 121.

Figure 13:
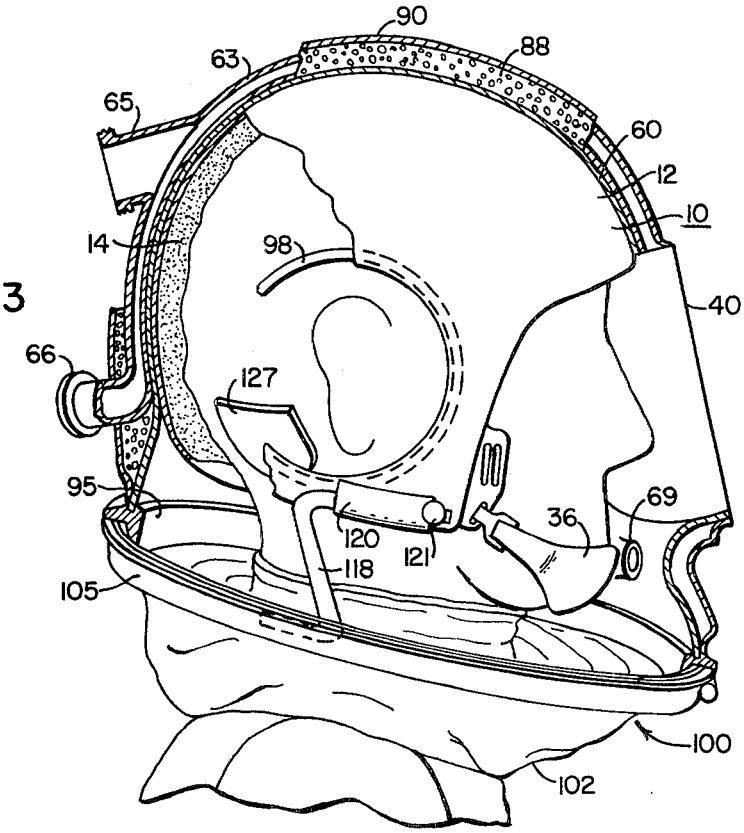
FIG. 13 illustrates the apparatus as worn by a diver, with portions of the apparatus broken away.

After the connection of the links 118 with the adapter unit 10, the helmet body may be donned and the entire assembly, with portions broken away, would be as illustrated in FIG. 13.

The piston effect tending to force the helmet off of the diver's head due to an outward differential pressure is counteracted in the present apparatus in the following manner. The upward force is transmitted through the rigid link member 118 to the adapter unit 10 by means of the connection to the receiver 120. The adapter unit 10, however, rather than being forced off the diver's head, is maintained in position by virtue of the chin strap 36, and thus there is no relative movement between the illustrated components. In order to distribute this upward force over an area greater than the chin strap 36, there may be provided other points of force transmittal contact of the adapter unit 10 with the diver's head. To this end, there is provided a plurality of firm pads, one of which, 127, is illustrated. Two such pads would be provided interior of the inner liner shell 12 and at a position beneath the mastoid protrusions of the diver to effectively reduce the load on the diver's chin to onehalf or one third of its previous value.

In an actual diving operation, and depending upon various factors, such as the design of an exhaust valve which may be utilized, the flexible neck-engaging membrane 102 may have a distended portion and a collapsed portion below it. Such would be true, not only in the standing position, but various other diver orientations. The distended portion would naturally displace a quantity of water, adding to the buoyancy forces. The previous consideration with respect to neutralizing the buoyancy of the diving helmet apparatus and the diver's head, is predicated upon some mean position of the collapse plane, that is the plane separating the distended from the collapsed portion of the flexible member 102.

I claim:

1. A diving helmet assembly comprising:

A. an adapter unit for placement on the diver's head and having a standardized outer surface;

B. a helmet body for placement on said adapter unit and having a standardized inner surface generally conforming to said outer surface of said adapter unit;

C. said helmet body including, i. a helmet body shell portion, the interior of which includes said standardized inner surface; and ii. insulation means disposed over the outside of said helmet body shell;

D. at least one gas conduction duct disposed on the outside of said helmet body shell; and E. said insulation means being also disposed over said gas conduction duct.

2. Apparatus according to claim 1 wherein said adapter unit includes:

A. a shell portion having said standardized outer surface; and

B. padding means interior of, and contacting said shell portion, for contact with the diver's head.

3. Apparatus according to claim 2 wherein:

A. said padding means is of open-cell foam construction.

4. Apparatus according to claim 2 wherein:

A. said padding means is comprised of a plurality of adjacent segments of respective thicknesses conforming to the contour of the diver's head.

5. Apparatus according to claim 2 which additionally includes:

A. a chin strap for maintaining said adapter unit immovable relative to the diver's head.

6. Apparatus according to claim 1 wherein:

A. said insulation means is a rigid insulation material.

7. Apparatus according to claim 6 wherein:

A. said rigid insulation material is a syntatic foam.

8. Apparatus according to claim 1 which includes:

A. an outer protective skin covering said insulation means.

9. A diving helmet assembly comprising:

A. an adapter unit for placement on the diver's head and having a standardized outer surface;

B. a helmet body for placement on said adapter unit and having a standardized inner surface generally conforming to said outer surface of said adapter unit;

C. a neck seal unit for sealing said helmet body to a diver worn complementary sealing unit;

D. said neck seal unit including, i. a neck ring; and ii. a flexible neck-engaging sealing membrane attached to said neck ring;

E. force transmittal means connecting said neck ring with said adapter unit; and F. means for maintaining said adapter unit on the diver's head in the presence of forces tending to remove it.

10. Apparatus according to claim 9 wherein:

A. said neck ring is oval.

11. Apparatus according to claim 9 wherein:

A. said helmet body includes a base ring at the base thereof;

B. said neck ring being engageable with said base ring; and

C. clamping means for maintaining said neck ring and said base ring in water-tight engagement.

12. Apparatus according to claim 9 wherein the means for maintaining said adapter unit on the diver's head in the presence of forces tending to remove it includes:

A. a chin strap connectable with said adapter unit.

13. Apparatus according to claim 12 which additionally includes:

A. firm padding means positioned on the inside of said adapter unit to contact the diver's head just below the mastoid protrusions.

14. A diving helmet assembly comprising:

A. an adapter unit for placement on the diver's head and having a standardized outer surface; and B. a helmet body for placement on said adapter unit and having a standardized inner surface generally conforming to said outer surface of said adapter unit;

C. predetermined ballast weights for attaining substantially neutral bouyancy of said assembly when containing the diver's head;

D. said adapter unit including protruding portions around the ear area of a wearer; and E. said ballast weights being positioned within said protruding portions.

* * * * *